United States Patent [19]

Baltensperger et al.

[11] 4,264,996

[45] May 5, 1981

[54] SUSPENSION-CABLE SUPPORT SADDLE FOR TRACK-TYPE SUSPENDED RAILWAY

[76] Inventors: Rudolf Baltensperger, Alte Kaiserstuhlstr. 157, CH 8181 Höri; Hans B. Pfister, Frohhaldenstr. 20, 8120 Bülach, both of Switzerland

[21] Appl. No.: 956,652

[22] Filed: Nov. 1, 1978

[30] Foreign Application Priority Data

Nov. 14, 1977 [CH] Switzerland ..... 13831/77

[51] Int. Cl.[3] ..... E01D 11/00

[52] U.S. Cl. ..... 14/21; 104/91; 104/125

[58] Field of Search ..... 104/123, 115, 124, 125, 104/89; 14/21, 18, 22, 5

[56] References Cited

U.S. PATENT DOCUMENTS

| | | | |
|---|---|---|---|
| 430,428 | 6/1890 | Lindenthal | 14/21 |
| 551,744 | 12/1895 | Brothers | 14/21 |
| 2,088,430 | 7/1937 | Nelles | 104/123 |

*Primary Examiner*—Richard A. Bertsch
*Attorney, Agent, or Firm*—Karl F. Ross

[57] ABSTRACT

A suspended railway has a track hung via a plurality of hangers from a suspension cable which is supported at intervals at the tops of towers. A beam is provided at each of these towers which bows the track when unloaded downwardly at the tower. A saddle is furthermore provided at the top of each of the towers and has an upwardly open seat receiving and supporting the suspension cable. This seat has a length measured parallel to the length of the beam which is equal to at least one-third of the length of the beam. Furthermore the seat has a central portion with a larger radius of curvature than its flanking end portions. The saddle is carried on rollers for rolling in a horizontal direction parallel to the suspension cables, and can even twist about a vertical axis perpendicular to this horizontal axis.

8 Claims, 3 Drawing Figures

SUSPENSION-CABLE SUPPORT SADDLE FOR TRACK-TYPE SUSPENDED RAILWAY

FIELD OF THE INVENTION

The present invention relates to a cable-support saddle for a track-type suspended railway.

BACKGROUND OF THE INVENTION

A suspended railway has at least one upper suspension cable supported at intervals at towers following catenary paths between the towers. Suspended from this upper cable by means of a plurality of horizontally spaced upright hangers or suspenders (see our copending application Ser. No. 956,654) of different lengths is one or more lower track cable or cables defining a generally straight and noncatenary path which may be level or inclined. In a light-duty low-speed system a passenger or freight car has a bogey or truck that rides directly on the track cable.

In a heavy-duty system the track cable carries a rigid track (see our copending application Ser. No. 956,442) on which the passenger or freight car rides (see German patent publication 1,905,686 whose U.S. equivalent is 3,541,964). Such a rigid track greatly decreases lateral sway, that is displacement of the track and car in a horizontal direction transverse to the direction of travel longitudinally along the cables, and permits heavy loads to be transported at high speeds.

Such a system is normally provided at each of the towers with at least one rounding or shaping beam (see copending application Ser. No. 956,442 which imparts to the track between the towers in the unloaded condition a negative curve, downward concavity, that is straightened out when these sections between the towers are loaded by the car traveling along the track (see German Pat. publication No. 2,149,871). The amount of vertical deflection at the tower is minimal, so that it is even possible to mount such a reinforcing beam on the tower in such a manner that it cannot move vertically relative thereto or at least that it can at most only rock about a horizontal axis fixed on the tower.

Stations (see copending application Ser. No. 956,443 now Pat. No. 4,211,171) must be provided along such a suspended railway for loading and unloading. Whether they are way stations through which the railway passes or terminal stations at which the transport path ends, such stations are invariably supported fixedly relative to the ground and are provided with stationary guide and support structure for the cars which must be fully stationary during any loading and unloading.

OBJECTS OF THE INVENTION

It is an object of this invention to provide an improved saddle for supporting the suspension cable of a suspended-track type railway.

Another object is to provide such a saddle which is compatible with the suspended railway described in the commonly owned and copending applications cited above, all of whose disclosures are herewith incorporated by reference.

SUMMARY OF THE INVENTION

These objects are attained according to the instant invention in a suspended railway of the above-described general type wherein the saddle is provided at the top of each of the towers, and each saddle has an upper surface forming an upwardly open seat that receives and supports the suspension cable or cables. Each such seat has a length in the plane of the respective suspension cable that is equal to at least one-third of the length of the reinforcement beam in the same plane, and has a central upwardly convex cable-engaging section which is of larger radius of curvature than a pair of upwardly convex and cable-engaging sections which flank the central section. Thus the suspension cable or cables can pass smoothly over this saddle which ensures excellent support of the underlying track, in particular at the critical region of each tower.

According to another feature of this invention a succession of vertical hangers of different lengths is provided between the suspension cable and the track. These hangers are spaced apart by a pretedermined horizontal distance, and the hangers immediately flanking the tower are each spaced horizontally from the respective end of the saddle by a distance equal generally to this horizontal spacing. Such construction ensures excellent weight distribution and eliminates the necessity of providing complex compensating hangers and cross braces at the towers.

In accordance with yet another feature of this invention the saddle is set up so that it can rock about a horizontal axis perpendicular to the above-described vertical plane in which the suspension cable lies. It can also be limitedly horizontally displaceable in this plane, and can even twist if necessary about a vertical axis lying in this plane. Thus external forces effective on the track and suspension cable will not be transmitted to the tower, but will be compensated for by appropriate shifting of the support saddle.

SPECIFIC DESCRIPTION

Figure 1:
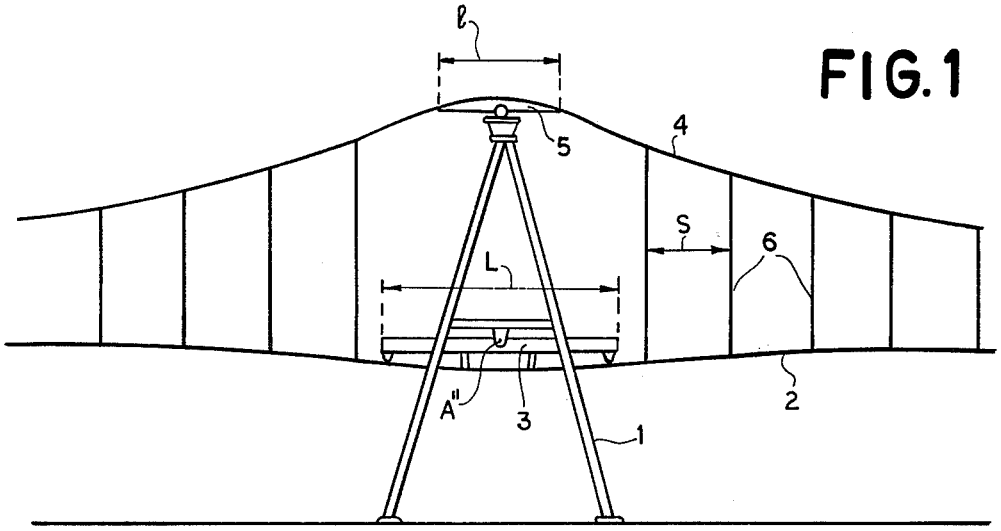
FIG. 1 is a side view of a segment of a suspended railway according to this invention.
Figure 2:
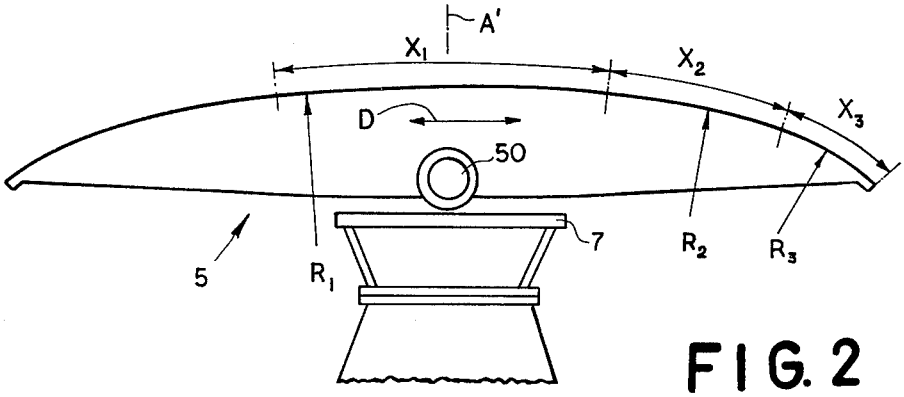
FIG. 2 is a large-scale side view of the support saddle according to this invention.
Figure 3:
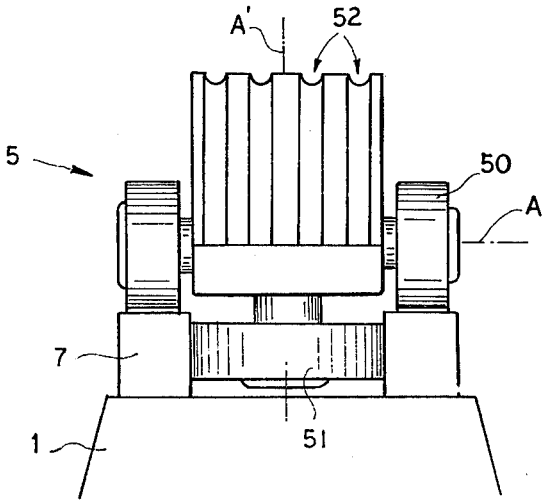
FIG. 3 is an end view of the support saddle shown in FIG. 2.

As shown in FIG. 1 a suspended railway has a plurality of towers 1 supporting a horizontally extending track 2 by means of hangers 6 spaced horizontally apart by a distance S and extending downwardly from a suspension cable 4 passing over a saddle 5 at the top of the tower 1. A stressing beam 3 is provided on each of the towers 1 below the saddle 5. Each such beam 3, as described in the above-cited copending application Ser. No. 906,854 now U.S. Pat. No. 4,208,969 is pivotal about a horizontal axis A″ perpendicular to the direction of elongation of the track 2 and has a horizontal length L. The saddle 5 as shown in FIG. 2 is formed along its upwardly convex upper surface with four grooves 52 constituting seats for four parallel suspension cables 4. These seats or grooves 52 each have a central section $x_1$ with a relatively large radius of curvature $R_1$. To each side of this central region $x_1$ is another shorter region $x_2$ with a smaller radius of curvature $R_2$. At the end of each of the grooves 52 is a third even shorter region $x_3$ having a yet shorter radius of curvature $R_3$.

The saddle 5 has an overall length l measured in the plane defined by the cables 4, hangers 6, and track 2 at the tower 1 which is equal to at least one-third of the length L measured in the same direction. Furthermore the spacing between each end of the saddle 5 and the nearest hanger 6 is generally equal to the spacing S for uniform weight distribution.

The region $x_1$ has an overall length equal to approximately one-third of the length l. The region $x_2$ has a length equal to approximately one-fifth of the length l, and each section $x_3$ has a yet shorter length equal to approximately one-seventh of the length l.

The saddle 5 is formed as a single casting and is supported on a pair of rollers 50 rotatable about an axis A and riding on respective horizontal rails 7 mounted on the top of the tower 1. In addition this saddle 5 carries on its lower side a further roller 51 engaged between the rails 7 and rotatable about an axis A'. Thus the saddle 5, and therewith the cables 4, can have three degrees of freedom:

rocking about the horizontal axis A,
twisting about the vertical axis A', and
sliding or rolling in the horizontal direction D.

The axis A' and the direction D lie in the plane described above and, indeed, define this plane. The axis A is perpendicular to this plane.

We claim:

1. In a suspended railway having a tower;

a suspension cable supported at the top of said tower and lying generally at said tower in a vertical plane; and a track hung from said suspension cable and lying generally in said plane thereof, the improvements comprising:

a beam at said tower above said track and below said cable and positioned to bow said track when unloaded downwardly at said tower;

a saddle at said top of said tower having an upper surface forming an upwardly open seat receiving and supporting said suspension cable, having a length in said plane equal to at least one-third of the length of said beam in said plane, having a central upwardly convex cable-engaging section of a predetermined relatively large radius of curvature, and having a pair of upwardly convex end cable-engaging sections flanking said central section and of predetermined relatively small radii of curvature;

means on said tower for limited horizontal displacement of said saddle in said plane relative to said tower; and means for limited pivoting of said saddle on said tower about an upright axis generally in said plane.

2. The improvement defined in claim 1 wherein said means includes at least one roller on said saddle rotatable about a horizontal axis generally perpendicular to said plane, and a horizontal rail extending on said tower in said plane and supporting and guiding said roller.

3. The improvement defined in claim 2 wherein said means includes two such rollers on said saddle rotatable about said axis and axially spaced from each other, and two such rails each engaging a respective one of said rollers.

4. The improvement defined in claim 2 wherein said saddle is rockable on said tower about said horizontal axis.

5. The improvement defined in claim 1 wherein said means for pivoting includes a roller rotatable thereon about said upright axis and engaged horizontally between said rails.

6. The improvement defined in claim 1, further comprising means for limited pivoting of said saddle on said tower about an upright axis generally in said plane.

7. The improvement defined in claim 6, further comprising means for limited rocking of said saddle on said tower about a horizontal axis generally perpendicular to said plane.

8. The improvement defined in claim 1, further comprising means for limited rocking of said saddle on said tower about a horizontal axis generally perpendicular to said plane.

* * * * *